US008123313B2

(12) United States Patent
Morgan et al.

(10) Patent No.: US 8,123,313 B2
(45) Date of Patent: Feb. 28, 2012

(54) DOOR MOTION DAMPENING SYSTEM

(75) Inventors: Karl S. Morgan, Des Plaines, IL (US); Robert Dam, Aurora, IL (US); Richard R. Herzog, Arlington Heights, IL (US); Kurt A. Kuehn, Des Plaines, IL (US); Alberto Bassi, Torrino (IT)

(73) Assignee: Illinois Tool Works Inc., Glenview, IL (US)

( * ) Notice: Subject to any disclaimer, the term of this patent is extended or adjusted under 35 U.S.C. 154(b) by 408 days.

(21) Appl. No.: 12/427,398

(22) Filed: Apr. 21, 2009

(65) Prior Publication Data

US 2009/0300884 A1 Dec. 10, 2009

Related U.S. Application Data

(60) Provisional application No. 61/059,034, filed on Jun. 5, 2008.

(51) Int. Cl.
*A47B 96/00* (2006.01)

(52) U.S. Cl. ..... 312/405; 49/138; 49/386; 49/506; 267/273

(58) Field of Classification Search ..... 16/334, 16/342; 49/138, 386, 387, 379, 400, 401, 49/402; 312/405; 188/290; 267/64.12, 273, 267/275, 276, 279, 281, 284
See application file for complete search history.

(56) References Cited

U.S. PATENT DOCUMENTS

| | | | | |
|---|---|---|---|---|
| 5,988,329 | A * | 11/1999 | Evans et al. | 188/296 |
| 6,213,881 | B1 * | 4/2001 | Sasa et al. | 464/24 |
| 6,336,252 | B1 * | 1/2002 | Bando | 16/307 |
| 6,390,255 | B2 * | 5/2002 | Kobori et al. | 188/290 |
| 6,922,869 | B2 * | 8/2005 | Bivens et al. | 16/54 |
| 6,945,621 | B2 * | 9/2005 | Shin | 312/405 |
| 7,254,958 | B2 * | 8/2007 | Kim et al. | 62/265 |
| 2001/0052741 | A1 * | 12/2001 | Yun | 312/405 |
| 2004/0148958 | A1 | 8/2004 | Park | 62/381 |
| 2004/0178710 | A1 | 9/2004 | Kim et al. | 312/405 |
| 2005/0144970 | A1 * | 7/2005 | Cho et al. | 62/441 |
| 2006/0119240 | A1 * | 6/2006 | Shin et al. | 312/405 |
| 2006/0138920 | A1 * | 6/2006 | Jang | 312/405 |
| 2006/0152121 | A1 * | 7/2006 | Son et al. | 312/405 |

(Continued)

FOREIGN PATENT DOCUMENTS

| | | | |
|---|---|---|---|
| DE | 10 2006 019 332 | A1 | 12/2006 |
| EP | 1 424 529 | A3 | 6/2005 |

(Continued)

OTHER PUBLICATIONS

International Search Report and Written Opinion for PCT/US2009/041523.

*Primary Examiner* — Jerry Redman
*Assistant Examiner* — Justin Rephann
(74) *Attorney, Agent, or Firm* — Mark W. Croll; Paul F. Donovan

(57) ABSTRACT

A system for dampening an opening motion of a door includes a frame, an access door and at least one dampening member. The access door is rotatably secured to the frame. The access door is configured to be moved with respect to the frame between closed and completely open positions. The at least one dampening member is secured to the access door or the frame. The dampening member(s) dampens movement of the access door toward the completely open position over a range of motion.

17 Claims, 11 Drawing Sheets

U.S. PATENT DOCUMENTS

| | | | | |
|---|---|---|---|---|
| 2006/0156458 | A1* | 7/2006 | Myers | 4/234 |
| 2006/0226750 | A1* | 10/2006 | Lee et al. | 312/405.1 |
| 2006/0282982 | A1 | 12/2006 | Kim et al. | 16/221 |
| 2007/0089273 | A1* | 4/2007 | Kang | 16/330 |

FOREIGN PATENT DOCUMENTS

| | | | |
|---|---|---|---|
| EP | 1 731 704 | A3 | 12/2006 |
| GB | 2438766 | | 5/2007 |
| WO | WO2008054115 | * | 5/2008 |

* cited by examiner

DOOR MOTION DAMPENING SYSTEM

RELATED APPLICATIONS

This application relates to and claims priority benefits from U.S. Provisional Patent Application No. 61/059,034 entitled "Refrigerator Door Dampening System," filed Jun. 5, 2008, which is hereby incorporated by reference in its entirety.

FIELD OF EMBODIMENTS OF THE INVENTION

Embodiments of the present invention generally relate to a door assembly, and more particularly, to a system for dampening movement of a secondary door, such as a home bar door, built into the door assembly, such as a main refrigerator door.

BACKGROUND

A conventional refrigerator typically includes a main door that allows a user to gain access to contents being cooled within an interior chamber of the refrigerator. Often, the main door pivots about an axis that is aligned with respect to the height of the refrigerator. Thus, the main door is configured to swing open away from the interior chamber along this axis.

Often, the interior chamber of the includes additional compartments. Indeed, an interior of the main door itself may include shelves and compartments for storing items, such as cans, bottles, produce, butter and the like. A secondary door may be positioned on the main door that allows a user to gain quick access to items stored within the door, or even in the interior chamber, without opening the large main door.

If a user is not careful, however, the secondary door may swing open too quickly. Such movement may cause items stored within the refrigerator to shift. Further, such quick, jarring movement may cause damage to the main and secondary doors.

SUMMARY OF EMBODIMENTS OF THE INVENTION

Certain embodiments of the present invention provide a system for dampening an opening motion of a door. The system includes a frame, an access door rotatably secured to the frame, and at least one first dampening member. The access door is configured to be moved with respect to the frame between closed and completely open positions. The at least one first dampening member is secured to the access door or the frame. The at least one first dampening member dampens movement of the access door toward the completely open position over a range of motion.

The at least one first dampening member may be at least one rotational damper. In this embodiment, at least one hinge is secured to the other of the access door or the frame. The at least one rotational damper connects to the at least one hinge.

Alternatively, the at least one first dampening member may be at least one linear damper secured to the frame. The at least one linear damper may be in an at-rest position when the access door is in the closed position. The at least one linear damper contacts the access door and exerts a resistive force into the access door during the movement of the access door toward the completely open position.

Optionally, the system may include at least one second dampening member. The at least one first dampening member may be at least one rotational damper, while the at least one second dampening member may be at least one linear damper.

The range of motion may be an entire range of motion from the closed position to the completely open position. Alternatively, the range of motion may be a portion of the entire range of motion from the closed position to the completely open position, such that an initial descent over the range of motion is undampened and a final descent over the range of motion is dampened.

Certain embodiments of the present invention provide a refrigerator door system that includes a main refrigerator door, an access door rotatably secured to said main refrigerator door, and first dampening members secured to the access door or the main refrigerator door.

The main refrigerator door may be configured to rotate about a first axis that is aligned with a height of a refrigerator. The access door may be configured to rotate about a second axis that is perpendicular to the first axis. The access door is configured to be moved with respect to the main refrigerator door between closed and completely open positions. The first dampening members dampen movement of the access door toward the completely open position over a range of motion.

Certain embodiments of the present invention provide a system for dampening an opening motion of a door. The system includes a frame, an access door rotatably secured to the frame, rotational damper housings secured to the access door, and hinges secured to the frame. The access door is configured to be moved with respect to the frame between closed and completely open positions. Each of the rotational damper housings includes a case and a rotational damper within the case. The rotational damper includes a post extending from a main body. The post is rotatably and resistively secured to the main body. Each of the hinges includes a pivot member having an opening. Each rotational damper housing connects to one of the hinges by way of the posts fixedly securing into the openings. The rotational dampers dampen movement of the access door toward the completely open position over a range of motion.

The main body comprises a tab radially extending therefrom. The tab may be positioned with a radial channel formed through the case. The tab is allowed to move through the radial channel such that an initial descent over the range of motion is undampened and a final descent over the range of motion is dampened.

Alternatively, the tab may be secured from movement within a slot formed through the case, wherein the range of motion is an entire range of motion from the closed position to the completely open position.

Figure 1:
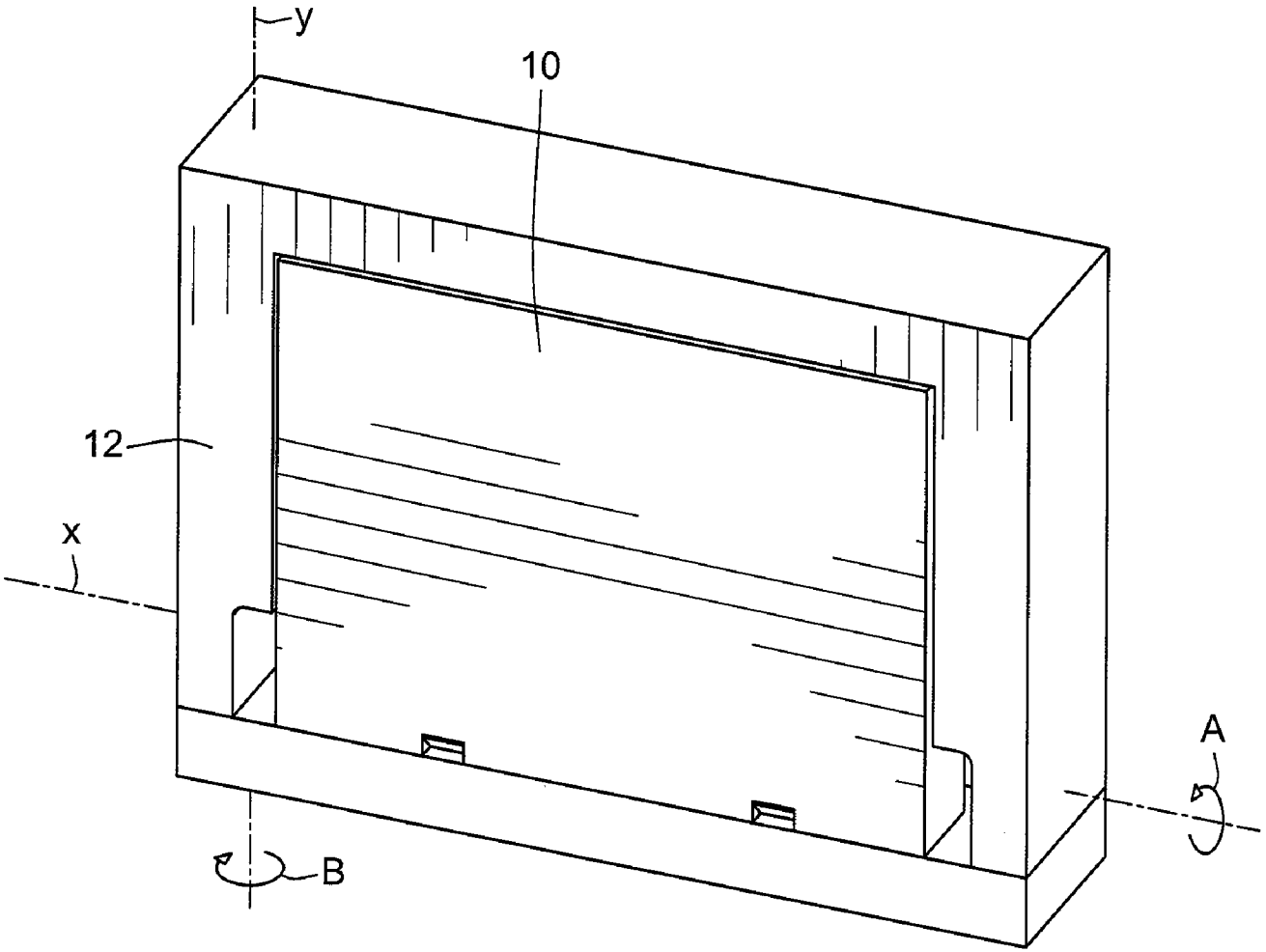
FIG. 1 illustrates an isometric front view of an access door positioned within a frame in a closed position, according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

FIG. 1 illustrates an isometric front view of an access door 10 positioned within a frame 12 in a closed position, according to an embodiment of the present invention. The frame 12 may be a main door of a refrigerator, while the access door 10 may be a secondary door, such as a home bar door, rotatably secured to the frame 12. The access door 10 is configured to swing open in the direction of arc A about axis X. If the frame is a main refrigerator door, the frame 12 may rotate open in the direction of arc B about axis Y.

Figure 2:
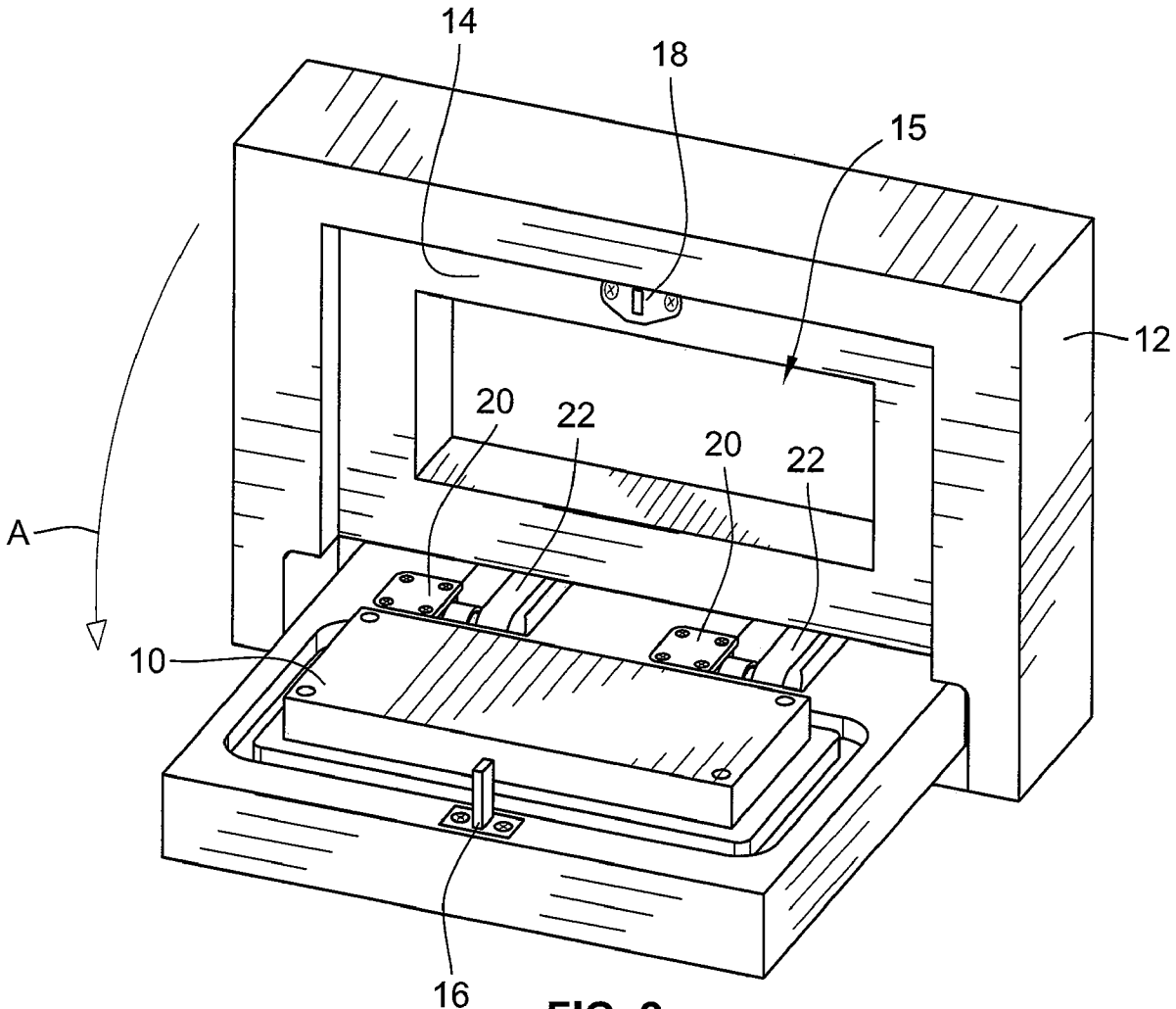
FIG. 2 illustrates an isometric front view of an access door positioned within a frame in an open position, according to an embodiment of the present invention.

FIG. 2 illustrates an isometric front view of the access door 10 positioned within the frame 12 in an open position. The frame 12 includes a recessed area 14 configured to receive the access door 10. The recessed area 14 surrounds an opening 15 that allows a user to gain access through the frame 12. A latch 16 is secured to the access door 10 and cooperates with a reciprocal latching mechanism 18 located on the recessed area 14. The latch 16 may be released from the latching mechanism 18 through a trigger on a handle, for example.

As shown in FIG. 2, the access door 10 swings away from the frame 12 in the direction of arc A when the latch 16 is released from the latching mechanism 18. The access door 10 is rotatably secured to the frame 12 by damper housings 20 that rotatably engage hinges 22 secured to the frame 12, thereby allowing the movement in the direction of arc A. The damper housings 20 cooperate with the hinges 22 to control the opening motion of the access door 10 with respect to the frame 12.

Figure 3:
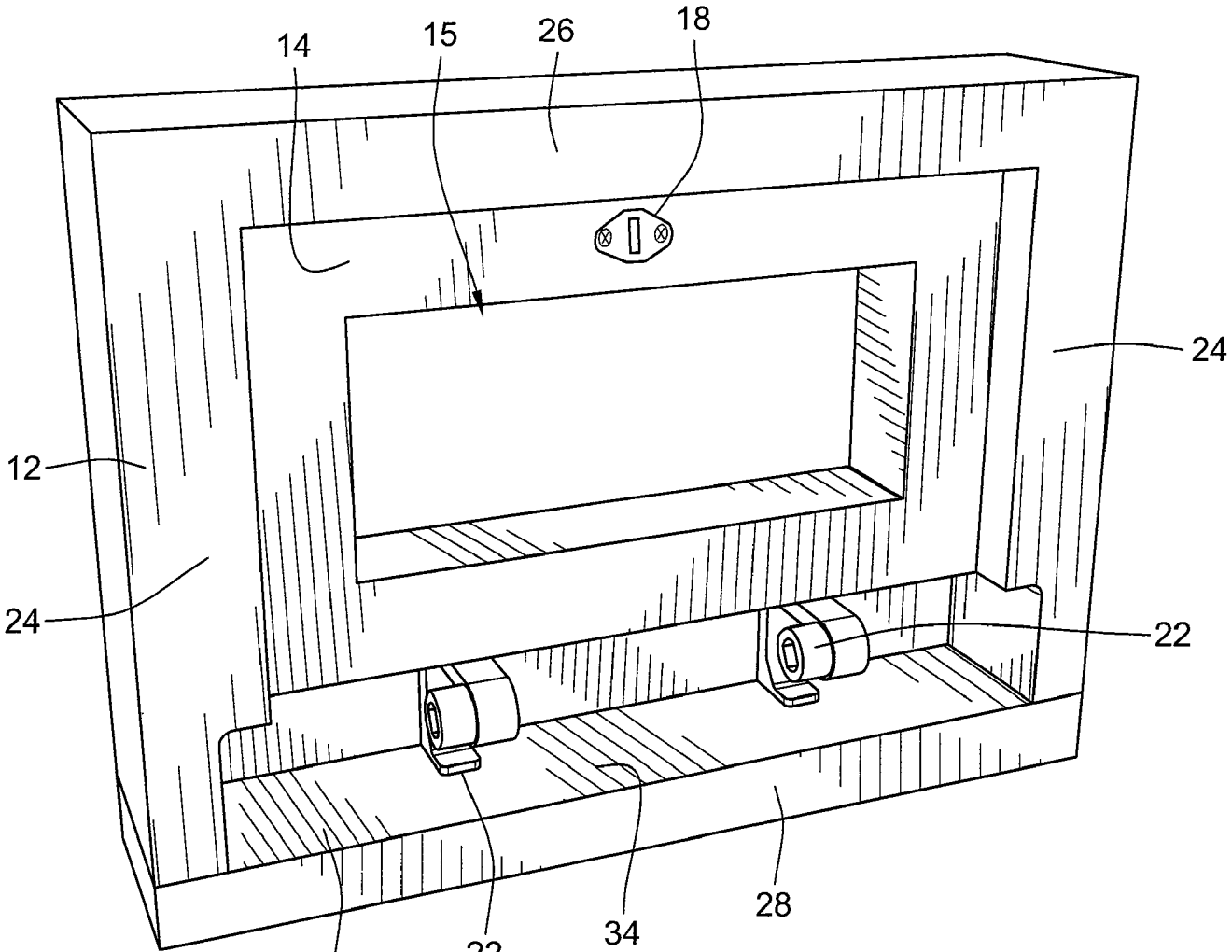
FIG. 3 illustrates an isometric front view of a frame, according to an embodiment of the present invention.

FIG. 3 illustrates an isometric front view of the frame 12. As noted above, the frame 12 may be a main refrigerator door. The frame 12 includes lateral walls 24 integrally connected to upper and lower walls 26 and 28, respectively. The recessed area 14 is formed within the walls 24, 26 and 28 and, as noted above, is configured to receive the access door 10 (shown in FIGS. 1 and 2). The central opening 15 is defined by interior edges of the recessed area 14.

A channel 30 is formed through the lower wall 28 below the recessed area 14. The channel 30 is configured to anchor the access door (shown in FIGS. 1 and 2) through a pair of hinges 22.

Figure 4:
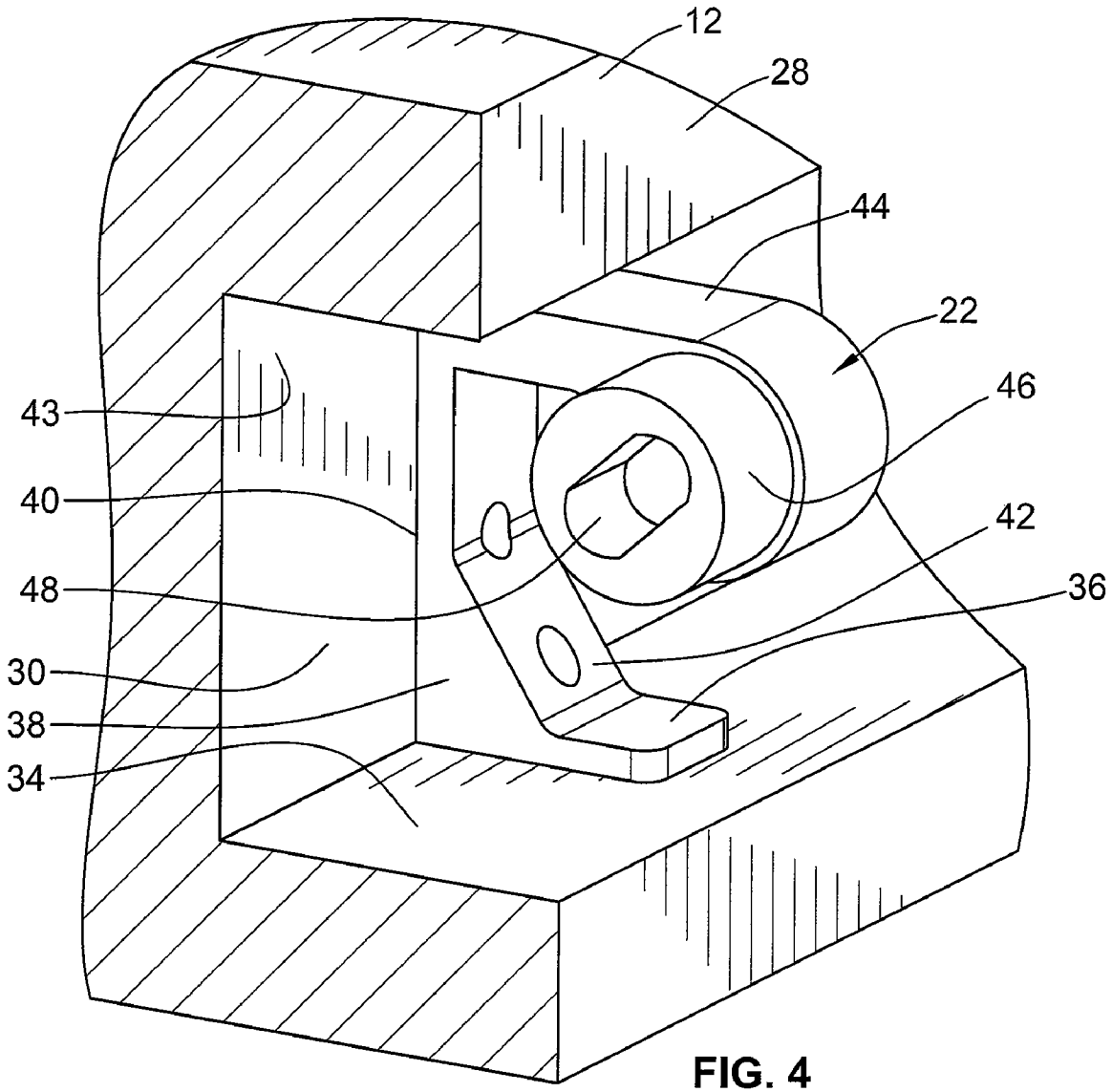
FIG. 4 illustrates an isometric front view of a hinge secured to a frame, according to an embodiment of the present invention.

FIG. 4 illustrates an isometric front view of one of the hinges 22 secured within the channel 30 of the frame 12. The hinge 22 includes a base 36 securely mounted to a ledge 34 defining a lower portion of the channel 30. The base 36 integrally connects to an upright support 38 having a straight back 40 and an angled front 42. The back 40 is securely fastened to a channel wall 43. A beam 44 outwardly extends from a top of the upright support 38 away from the channel wall 43. A cylindrical pivot member 46 extends perpendicularly from the an outer end of the beam 44. A diamond shaped opening 48 is formed through at least a portion of a central axis of the pivot member 46. The opening 48 may be various other shapes and sizes. In general, the opening 48 is configured to receive and retain a reciprocal portion of a damper.

Figure 5:
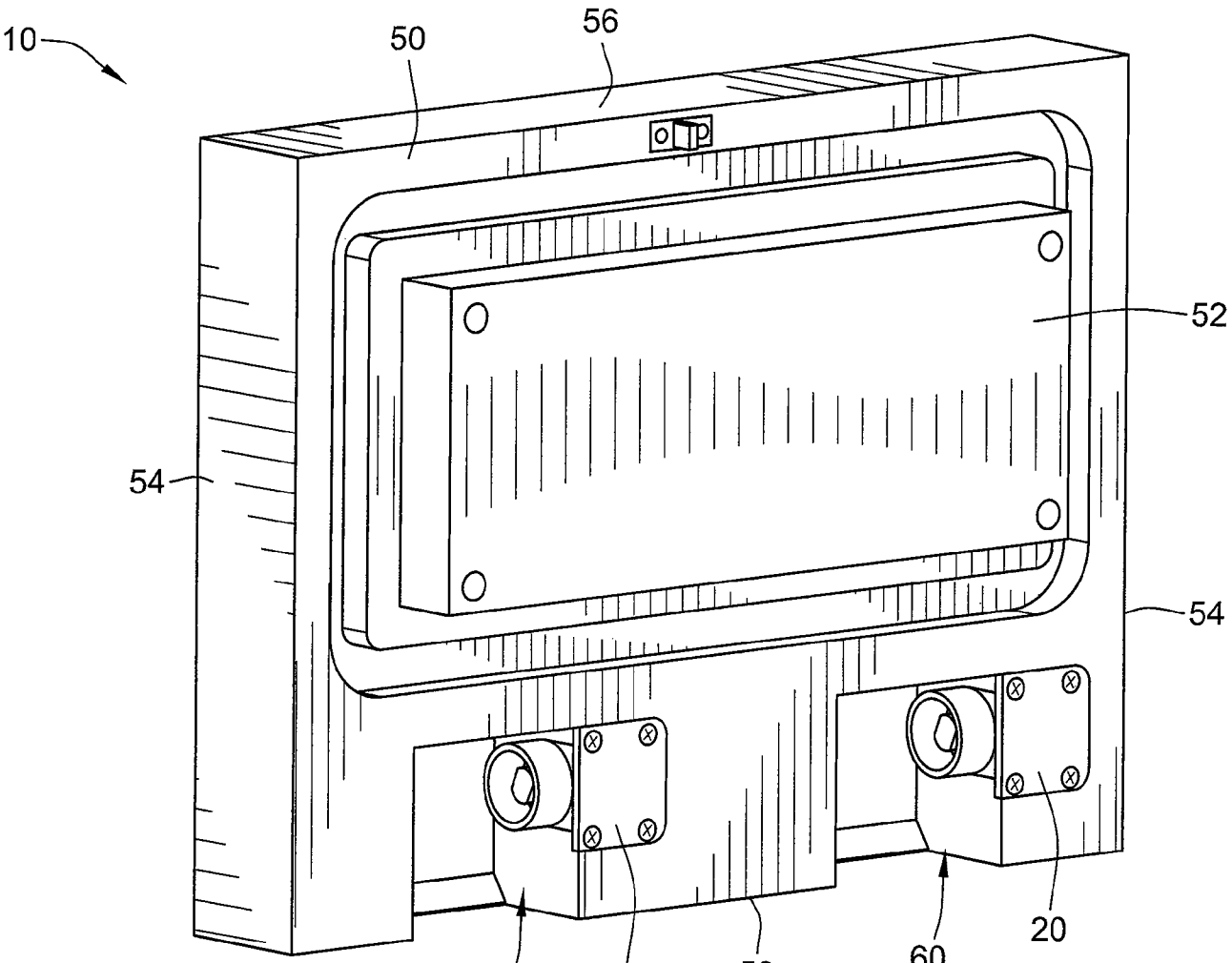
FIG. 5 illustrates an isometric interior view of an access door, according to an embodiment of the present invention.

FIG. 5 illustrates an isometric interior view of the access door 10. The access door 10 includes a flat main body 50, which may include strengthening and/or insulating slabs 52 secured thereon. The main body 50 includes lateral edges 54 integrally formed with and connected to upper and lower edges 56 and 58, respectively. Hinge chambers 60 are formed through the lower edge 58 and are configured to receive the hinges 22. The damper housings 20 are secured in damper chambers connected to the hinge chambers 60.

Figure 6:
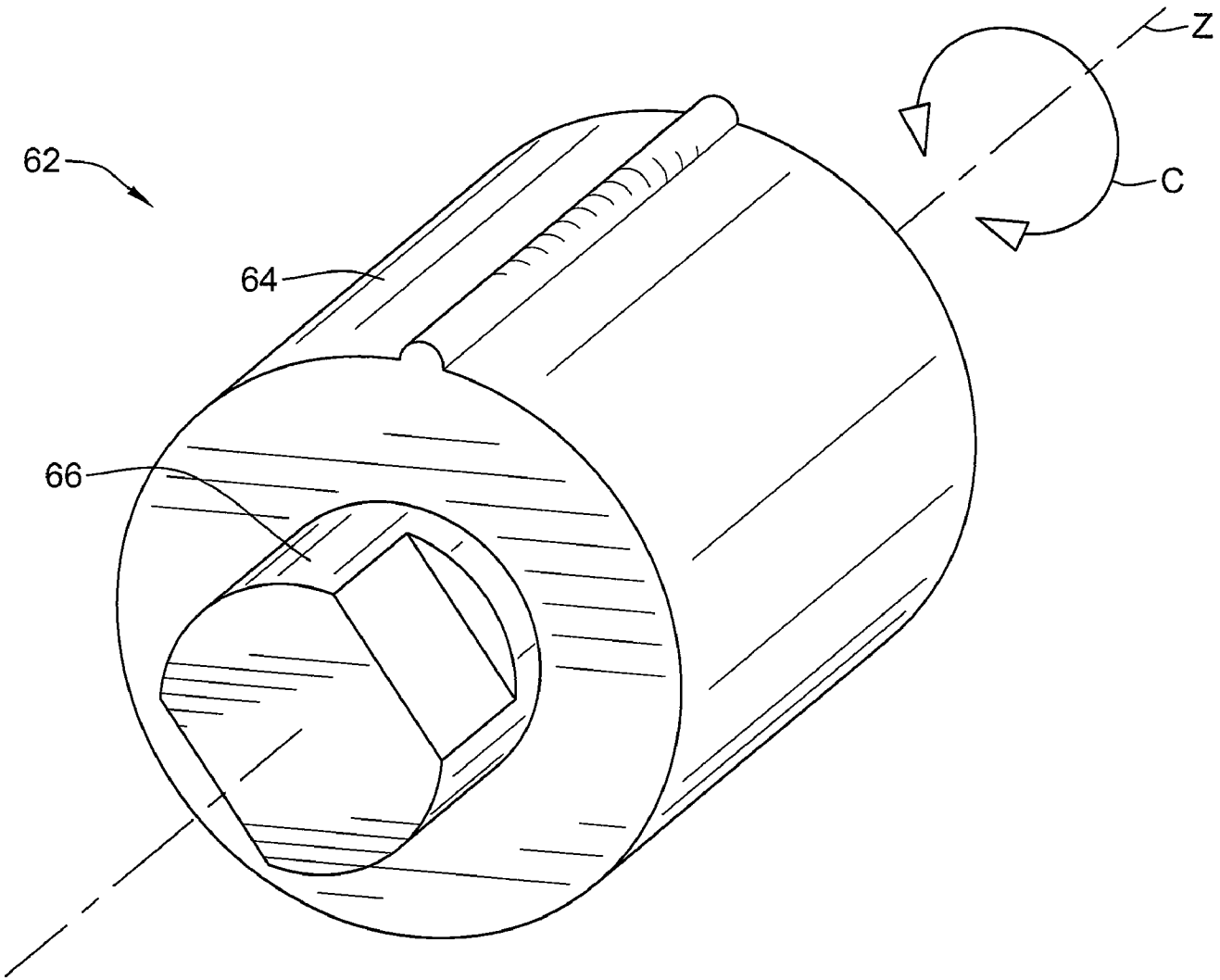
FIG. 6 illustrates an isometric view of a rotational damper, according to an embodiment of the present invention.

FIG. 6 illustrates an isometric view of a rotational or rotary damper 62, according to an embodiment of the present invention. The rotational damper 62 is configured to be positioned within a main body 64 of the damper housing 20 (shown, for example, in FIG. 5). The rotational damper 62 includes a main body 64 having a central post 66 extending therefrom. The central post 66 is shaped and sized to be securely retained within the opening 48 (shown in FIG. 4) of the hinge 22 (shown in FIG. 4). The rotational damper 62 includes resistive members, such as a series of springs, torsion members or the like secured to the post 66 and an interior of the main body 64. As such, rotational movement of the post 66 with respect to the main body 64 about a central axis Z, and vice versa, is resisted. The rotational damper 62 may be tuned depending on a particular application. That is, more or less resistive force may be implemented, depending on design considerations.

Figure 7:
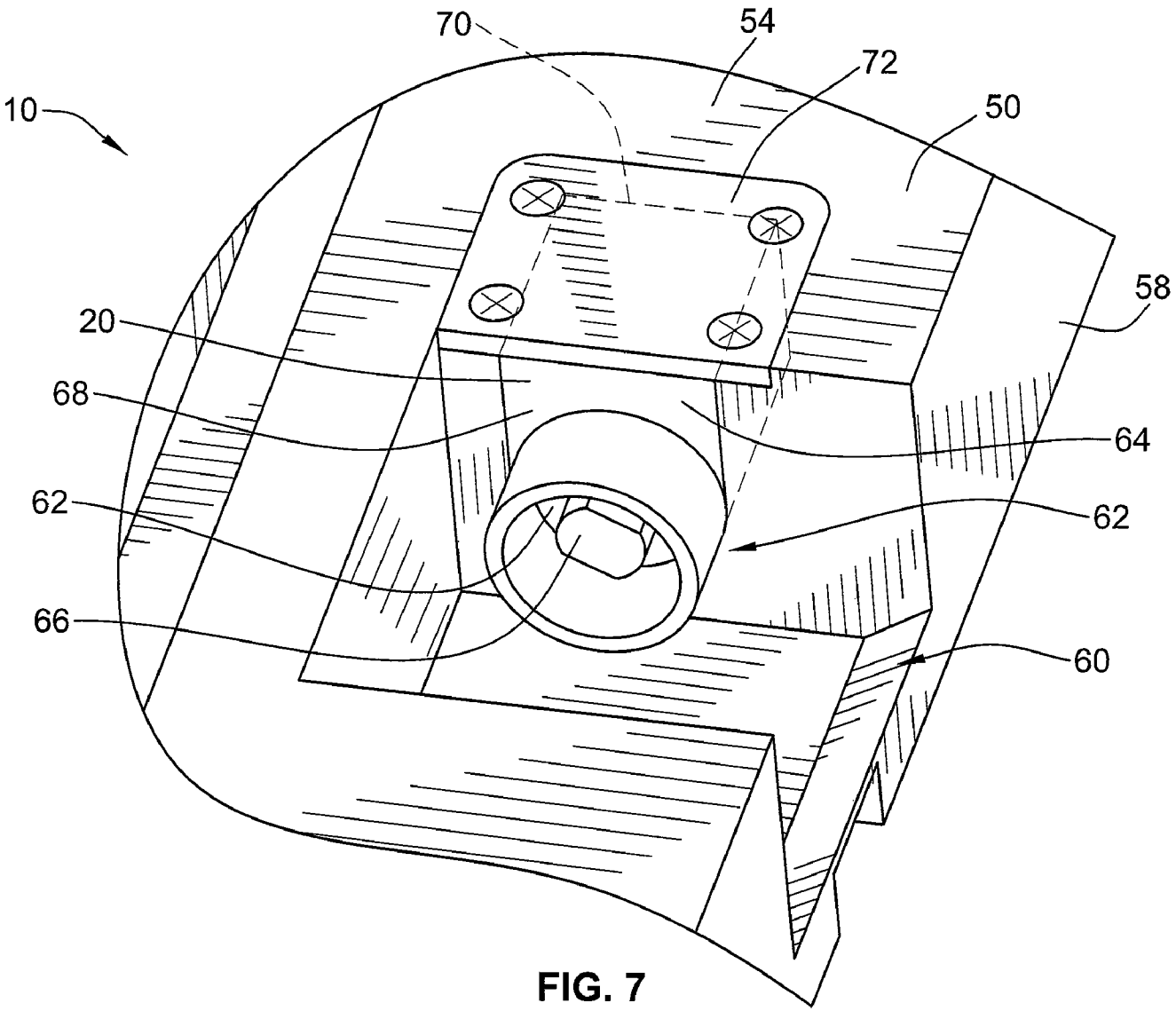
FIG. 7 illustrates an isometric view of a damper housing secured to an access door, according to an embodiment of the present invention.

FIG. 7 illustrates an isometric view of the damper housing 20 secured to the access door 10. The rotational damper 62 is securely positioned within a case 68 of the damper housing 20. The case 68 is received and retained within a damper chamber 70. A plate 72 is fastened to the access door 10 over the damper housing 20, thereby securing the damper housing 20 within the damper chamber 70. The main body 64 of the rotational damper 62 may be fixed within the case 68. As such, the post 66 is allowed to rotate with respect to the main body 64, but movement of the post 66 with respect to the main body 64 is dampened by the resistive force of the rotational damper 62. Optionally, the main body 64 of the rotational damper 62 may be allowed to rotate within the main body 64 of the damper housing 20 over a limited range.

Figure 8:
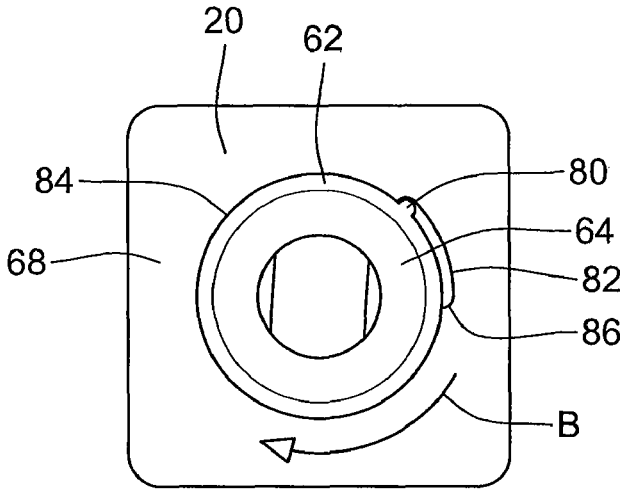
FIG. 8 illustrates a rear view of a damper housing, according to an embodiment of the present invention.

FIG. 8 illustrates a rear view of the damper housing 20, according to an embodiment of the present invention. The main body 64 of the rotational damper 62 may include a tab 80 radially extending therefrom. When the rotational damper 62 is inserted into the case 68 of the damper housing 20, the tab 80 is positioned within a radial channel 82 extending from a central channel 84 into which the rotational damper 62 is positioned. As shown in FIG. 8, the radial channel 82 extends over a radial sweep of approximately 75°, but may extend over smaller or greater radial areas, depending on the range of undampened motion (described below) desired for a particular application. The tab 80 is allowed to move through the radial channel 82. Thus, when the post 66 (shown in FIG. 6) of the rotational damper 62 is secured within the reciprocal opening 48 (shown in FIG. 4), as the access door 10 (shown in FIGS. 1 and 2) moves through the arc defined by the radial channel 82, the entire main body 64 rotates along with the post 66, thereby exerting no dampening resistive force. However, when the tab 80 abuts in edge 86 defining an end of the radial channel 82, the main body 64 of the damper housing 20 is prevented from further rotation in the direction of arc B. As such, while the post 66 may continue to rotate in the direction of arc B, the rotational damper 62 dampens extended motion in this direction through the resistive members, such as springs, torsion members and the like, that connect the post 66 to an interior of the case 68. In this manner, movement of the access door 10 may be unimpeded over an initial range defined by the radial channel 80. However, subsequent descending movement of the access door 10 past this initial range is dampened, thereby preventing the access door 10 from slamming open. The undampened initial descent provides for quicker opening of the access door, but, similar to a skydiver using a parachute, the final descent is slowed to prevent damage.

Optionally, the system may be configured so that a first resistive force is exerted by the rotational dampers over an initial descent, such as the first 45° of motion, while an increased second resistive force is exerted over the final descent, such as a final 45° of motion. That is, rotational dampers may exert some resistive force as the tab 80 moves through the radial channel 82.

Figure 9:
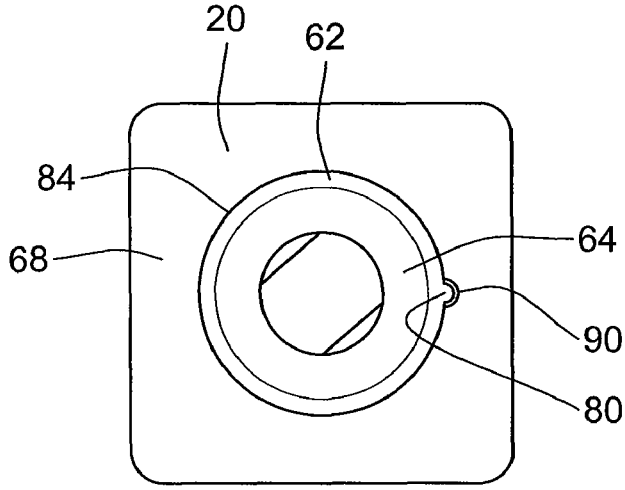
FIG. 9 illustrates a rear view of a damper housing, according to an embodiment of the present invention.

FIG. 9 illustrates a rear view of the damper housing 20, according to an embodiment of the present invention. In this embodiment, the case 68 of the damper housing 20 includes a slot 90 connected to the central channel 84. The tab 80 of the main body 64 is keyed into this slot 90. As such, the tab 80, and therefore the main body 64, are prevented from rotating with respect to the case 68. In this embodiment, the rotational damper 62 provides resistive dampening over an entire range of motion of the access door 10 (shown in FIGS. 1 and 2). Unlike the embodiment shown in FIG. 8, there is no portion of the descending motion of the access door 10 that is not dampened.

Thus, the embodiment of the damper housing 20 shown in FIG. 9 provides dampening resistance over an entire range of motion, while the embodiment shown in FIG. 8 provides for an undampened initial descent and dampened final descent.

Figure 10:
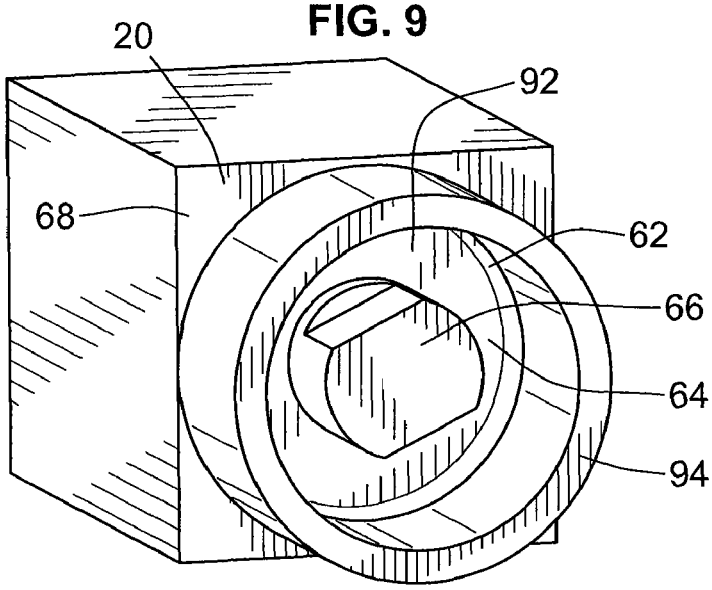
FIG. 10 illustrates a front view of a damper housing, according to an embodiment of the present invention.
Figure 11:
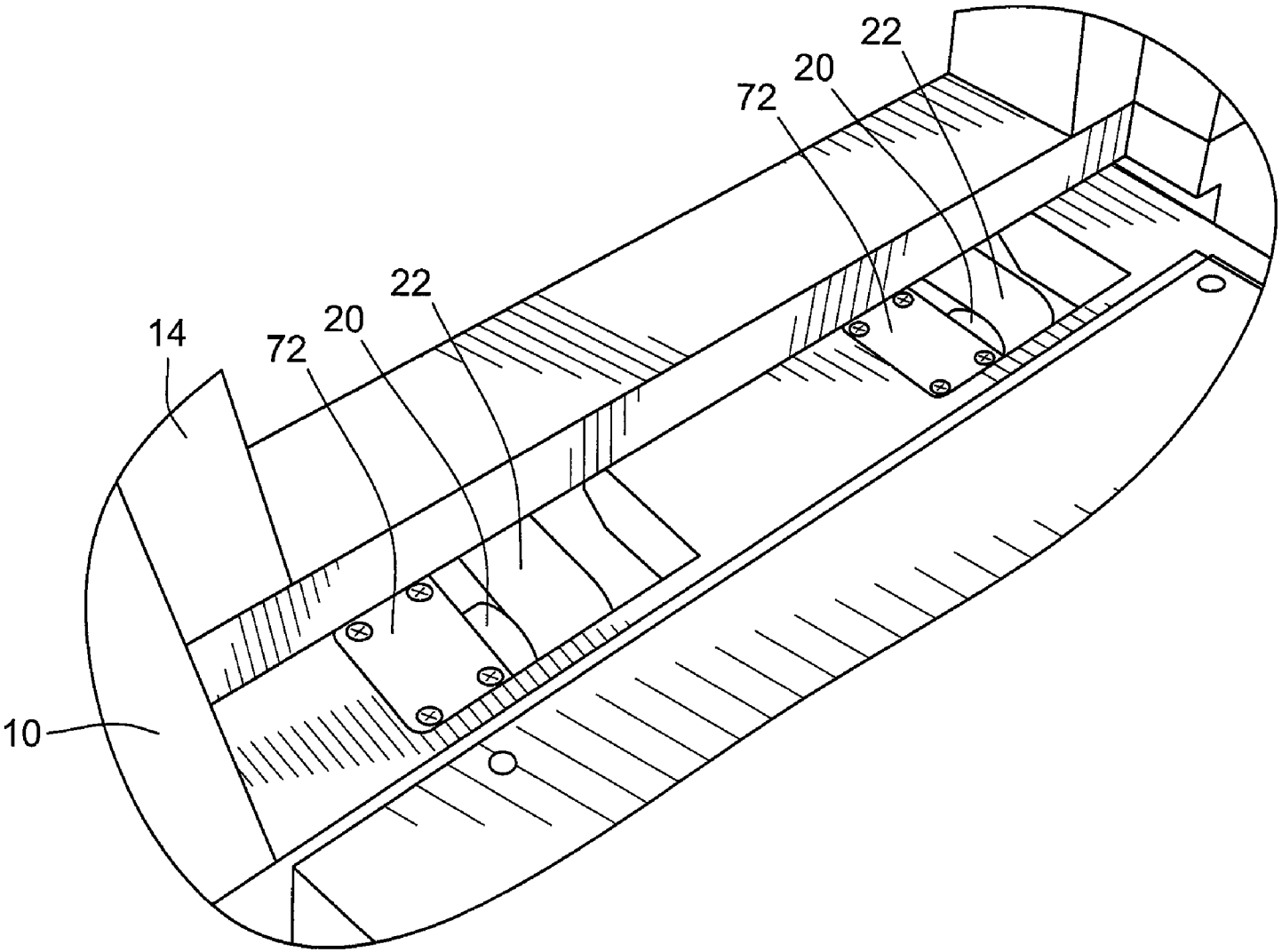
FIG. 11 illustrates an isometric view of damper housings of an access door rotatably secured to hinges of a frame, according to an embodiment of the present invention.

FIG. 10 illustrates a front view of the damper housing 20. Referring to FIGS. 4 and 10, the cylindrical pivot member 46 is positioned within a central reciprocal opening 92 formed in the case 68. FIG. 11 illustrates an isometric view of damper housings 20 of the access door 10 rotatably secured to the hinges 22 of the frame 12. Referring to FIGS. 1, 2, 5, 7, 10 and 11, outer walls of the pivot members 46 rotatably abut against interior surfaces of outer cylindrical walls 94 defining the opening 92. The posts 66 are securely positioned within the openings 48. That is, the posts 66 are prevented from rotating with respect to the pivot members 46. In this manner, when the access door 10 is opened, the hinges 22 and posts 66 remain fixed in position, while the cases 68 rotate about the pivot members 46, thereby causing the main bodies 64 of the rotational dampers 62 to rotate in response. The rotational dampers 62 dampen motion of the access door 10, as described above with respect to FIGS. 8 and 9. Thus, embodiments of the present invention provide a system that ensures that the access door 10 does not slam open. Instead, the system ensures that the access door comes to a controlled, safe stop.

Embodiments of the present invention may use more or less than two damper housings 20 and two hinges 22. That is, the access door 10 may include one damper housing 20, for example, while the frame 12 may include one hinge 22 connected to the damper housing 20.

Figure 12:
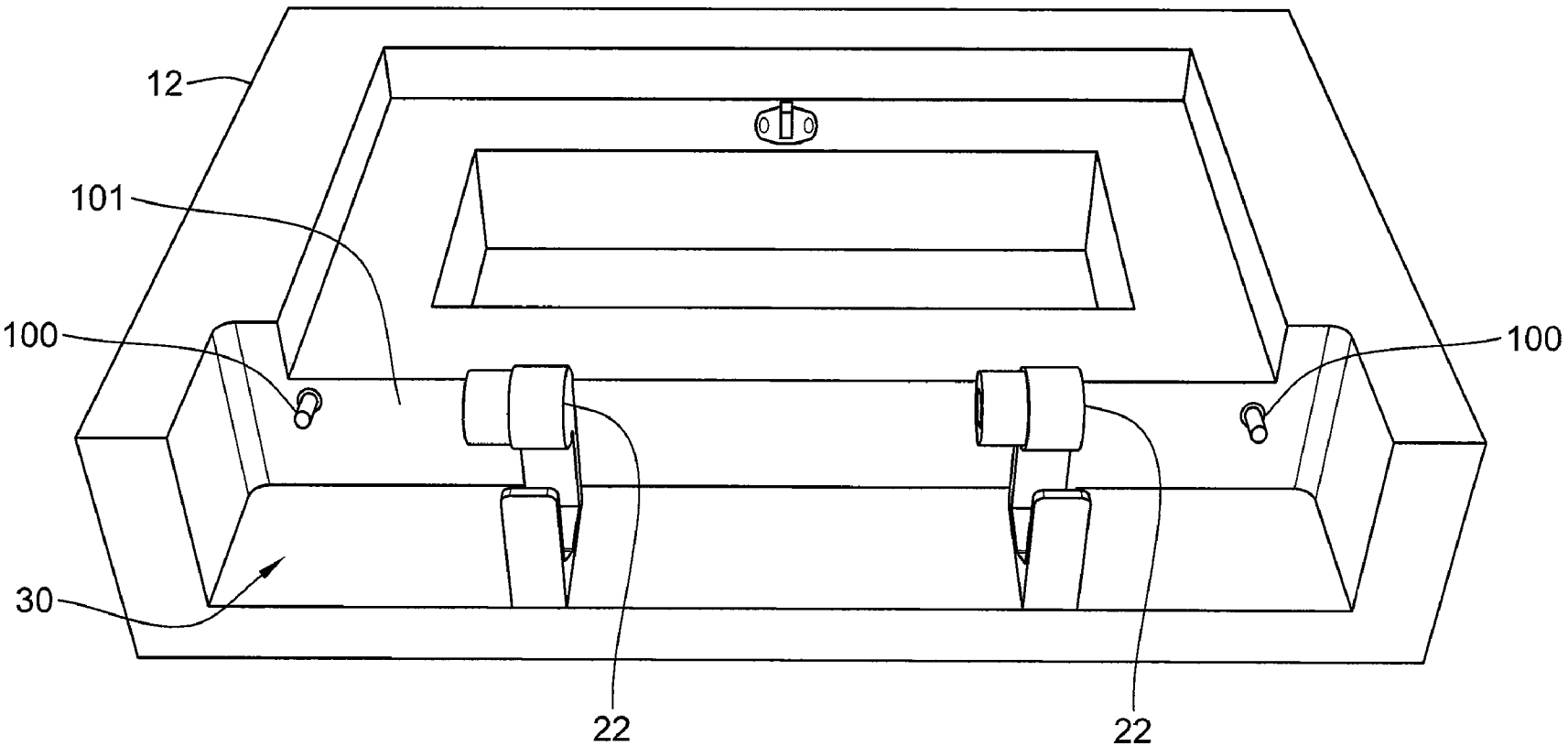
FIG. 12 illustrates an isometric view of a frame having linear dampers, according to an embodiment of the present invention.

FIG. 12 illustrates an isometric view of the frame 12 having linear dampers 100. The frame 12 is similar to that described above, except it includes the linear dampers 100. The linear dampers 100 may be used with, or instead of, the rotational dampers 62, described above. The linear dampers 100 extend downwardly from an upper wall 101 defining the channel 30 formed through the lower wall 28 (the ledge 34 has been removed to clearly show the linear dampers 100).

Figure 13:
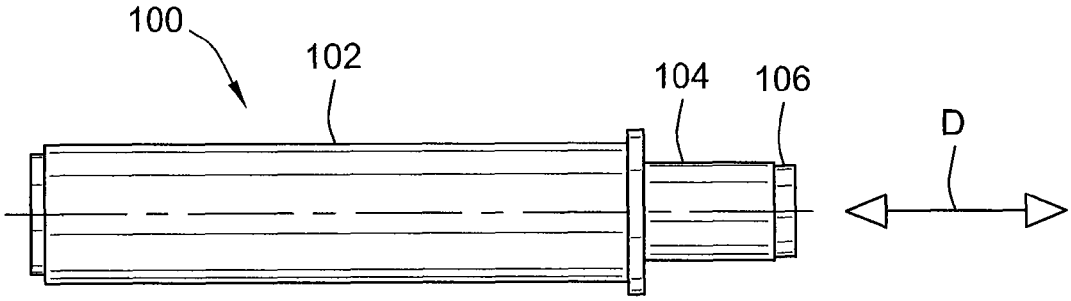
FIG. 13 illustrates an isometric view of a linear damper, according to an embodiment of the present invention.
Figure 14:
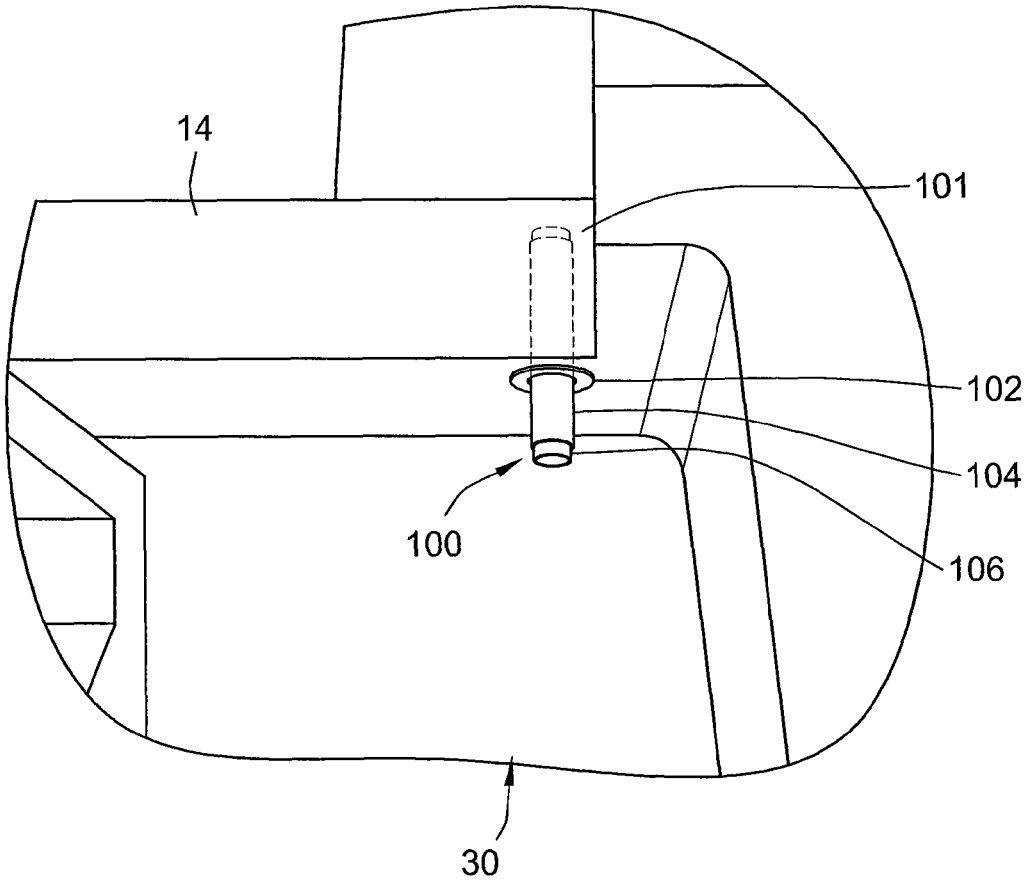
FIG. 14 illustrates a front view of a linear damper secured to a frame, according to an embodiment of the present invention.

FIG. 13 illustrates an isometric view of the linear damper 100. FIG. 14 illustrates a front view of the linear damper 100 secured to the frame 12. Referring to FIGS. 12-14, the linear damper 100 includes a main casing 102 that is anchored within the frame 12 (shown in FIG. 12). A beam 104 extends axially from the main casing 102 and is configured to move in linear directions denoted by line D. The beam 104 is connected to springs or other resistive members secured within the main casing 102. Each linear damper 100 may be similar to a shock absorber.

A distal end 106 of the beam 104 abuts into a lower end of the access door 10 (shown in FIGS. 1 and 2) when the access door 10 is opened. When the access door 10 is closed, the beams 104 do not abut the access door 10. However, as the access door 10 begins to open, the distal ends 106 come into contact with the lower end of the access door 10. During this motion, the linear damper 100 exerts a resistive force into the access door 10 that slows the opening motion of the access door 10 with respect to the frame 12. As the access door 10 continues to open, the access door 10 pushes the beam 104 further into the main casing 102. Consequently, the resistive force exerted by the linear damper 100 increases with increased opening movement of the access door 10.

As noted above, the linear dampers 100 may be used by themselves to dampen opening motion of the access door 10. Alternatively, the linear dampers 100 may be used in conjunction with the rotational dampers 20.

Thus, embodiments of the present invention provide a system of dampening opening motion of an access door with respect to a frame. Embodiments of the present invention may be used with respect to a secondary door, such as a home bar door, positioned on a refrigerator door.

Embodiments of the present invention keep the access door from slamming down into an open position. As the door rotates from its closed position to a completely open position, through a range of motion of, for example, 90°, the dampers may control the initial rate of descent at a first rate, and the final descent at a second rate, in order to compensate for the momentum of the opening door. The variable dampening system, whether through rotational dampers that allow for variable rates of dampening, and/or linear dampers, controls the opening of the door at varying rates of deceleration, depending on the weight of the access door and the desired effect. Moreover, additional dampers providing an increased or decreased dampening effect may also be used.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A system for dampening an opening motion of a door, the system comprising:

a frame including lateral walls integrally connected to upper and lower walls, wherein a recessed area is formed within said lateral, upper, and lower walls, said recessed area surrounding a central opening formed through said frame, and wherein a channel is formed through said frame below said recessed area and said central opening;

at least one hinge having at least a portion within said channel below said recessed area and said central opening;

an access door rotatably secured to said frame through said at least one hinge, wherein said access door is configured to be moved with respect to said frame between closed and completely open positions; and at least one rotational damper secured to said access door or said frame, wherein said at least one rotational damper operatively connects to said at least one hinge;

at least one linear damper vertically extending from a horizontal surface of said lower wall of said frame into said channel below said recessed area and said central opening, wherein said at least one linear damper is perpendicular to said horizontal surface, said at least one rotational damper and said at least one linear damper dampening movement of said access door toward the completely open position over a range of motion.

2. The system of claim 1, said at least one linear damper being in an at-rest position when said access door is in the closed position, and said at least one linear damper contacting said access door and exerting a resistive force into said access door during the movement of said access door toward the completely open position.

3. The system of claim 1, wherein the range of motion is an entire range of motion from the closed position to the completely open position.

4. The system of claim 1, wherein the range of motion is a portion of the entire range of motion from the closed position to the completely open position, wherein an initial descent over the range of motion is undampened and a final descent over the range of motion is dampened.

5. The system of claim 1, wherein said frame forms a portion of a main refrigerator door, and said access door is a secondary door positioned on said main refrigerator door.

6. The system of claim 1, wherein said access door includes at least one damper chamber connected to at least one hinge chamber, wherein said at least one rotational damper is secured within said at least one damper chamber, and wherein said at least one rotational damper operatively connects to said at least one hinge within said at least one hinge chamber.

7. A refrigerator door system comprising:

a main refrigerator door having a recessed area surrounding a central opening formed through said main refrigerator door, and wherein a channel is formed through said main refrigerator door below said recessed area and said central opening, said main refrigerator door being configured to rotate about a first axis;

hinges having at least portions within said channel below said recessed area and said central opening;

an access door rotatably secured to said main refrigerator door through said hinges, said access door configured to rotate about a second axis that is perpendicular to the first axis, wherein said access door is configured to be moved with respect to said main refrigerator door between closed and completely open positions; and rotational dampers secured to said access door or said main refrigerator door, wherein said rotational dampers operatively connect to said hinges;

linear dampers vertically extending from a horizontal surface of said main refrigerator door into said channel below said recessed area and said central opening, wherein said linear dampers are perpendicular to said horizontal surface, said rotational and linear dampers dampening movement of said access door toward the completely open position over a range of motion.

8. The system of claim 7, said linear dampers being in an at-rest position when said access door is in the closed position, and said linear dampers contacting said access door and exerting a resistive force into said access door during the movement of said access door toward the completely open position.

9. The system of claim 7, wherein the range of motion is an entire range of motion from the closed position to the completely open position.

10. The system of claim 7, wherein the range of motion is a portion of the entire range of motion from the closed position to the completely open position, wherein an initial descent over the range of motion is undampened and a final descent over the range of motion is dampened.

11. The system of claim 7, wherein said access door includes damper chambers connected to hinge chambers, wherein said rotational dampers are secured within said damper chambers, and wherein said rotational dampers operatively connect to said hinges within said hinge chambers.

12. A system for dampening an opening motion of a door, the system comprising:

a frame having a recessed area that surrounds a central opening formed through said frame, and wherein a channel is formed through said frame below said recessed area and said central opening;

an access door rotatably secured to said frame, wherein said access door is configured to be moved with respect to said frame between closed and completely open positions;

rotational damper housings secured to said access door, each of said rotational damper housings comprising a case and a rotational damper within said case, said rotational damper comprising a post extending from a main body, said post being rotatably and resistively secured to said main body;

hinges having portion secured to said frame within said channel below said recessed area and said central opening, each of said hinges comprising a pivot member having an opening, each of said rotational damper housings connecting to one of said hinges by way of said posts fixedly securing into said openings, said rotational dampers dampening movement of said access door toward the completely open position over a range of motion; and linear dampers vertically extending from a horizontal surface of said frame into said channel below said recessed area and said central opening, wherein said linear dampers are perpendicular to said horizontal surface.

13. The system of claim 12, said dampers being in an at-rest position when said access door is in the closed position, and said linear dampers contacting said access door and exerting a resistive force into said access door during the movement of said access door toward the completely open position.

14. The system of claim 12, wherein said main body comprises a tab radially extending therefrom, said tab being positioned with a radial channel formed through said case, said tab being allowed to move through said radial channel such that an initial descent over the range of motion is undampened and a final descent over the range of motion is dampened.

15. The system of claim 12, wherein said main body comprises a tab radially extending therefrom, said tab being secured from movement within a slot formed through said case, wherein the range of motion is an entire range of motion from the closed position to the completely open position.

16. The system of claim 12, wherein said frame forms a portion of a main refrigerator door, and said access door is a secondary door positioned on said main refrigerator door.

17. The system of claim 12, wherein said access door includes damper chambers connected to hinge chambers, wherein said rotational damper housings are secured within said damper chambers, and wherein said damper housings operatively connect to said hinges within said hinge chambers.

* * * * *